US006427560B1

(12) United States Patent
Shea

(10) Patent No.: US 6,427,560 B1
(45) Date of Patent: Aug. 6, 2002

(54) SCREWDRIVER DEVICE

(76) Inventor: Hang Haw Shea, No. 27-1, Szu-Hu, Hu 3, Lin 16, Chu-Sha Tsun, Chin-Cheng Chen, Chin-Men Hsien, Fu-Chien (TW)

( * ) Notice: Subject to any disclaimer, the term of this patent is extended or adjusted under 35 U.S.C. 154(b) by 0 days.

(21) Appl. No.: 09/931,000

(22) Filed: Aug. 17, 2001

(51) Int. Cl.[7] ..... B25B 13/00
(52) U.S. Cl. ..... 81/58.1; 81/30
(58) Field of Search ..... 81/58.1, 58.3, 81/30, 57.3, 57.39, 60

(56) References Cited

U.S. PATENT DOCUMENTS 508,845 A * 11/1893 Schaller ..... 81/58.1
795,434 A * 7/1905 Gagnon ..... 81/58.1
818,761 A * 4/1906 Hanes et al. ..... 81/58.1
1,601,767 A * 10/1926 Peterson ..... 81/58.1
2,982,160 A * 5/1961 Little ..... 81/58.1
3,375,860 A * 4/1968 Vosbikian et al. ..... 81/30
3,508,455 A * 4/1970 Miller ..... 81/58.1
3,575,069 A * 4/1971 White ..... 81/58.1
3,957,096 A * 5/1976 Rodman ..... 81/58.3
4,206,794 A * 6/1980 Reese ..... 81/30
4,735,119 A * 4/1988 Riley ..... 81/57.3
5,152,196 A * 10/1992 Garrett ..... 81/58.1
6,138,531 A * 10/2000 Lamons ..... 81/60

* cited by examiner

*Primary Examiner*—James G. Smith
*Assistant Examiner*—Hadi Shakeri
(74) *Attorney, Agent, or Firm*—Dennison, Schultz & Dougherty

(57) ABSTRACT

A screwdriver device comprises a handle; a shank being rotatably mounted within the handle; a gear provided at the middle part on the shank; an operating lever extending from an upper plate and a lower plate formed therewith; a claw member provided at a suitable position formed between the upper plate and the lower plate which are superposed, the claw member having two pointed corners at the front end thereof which are switchable to the left or right to be respectively engaged into a groove of the gear and which, in use, move the shank to rotation; and a rotary member provided at a suitable position on the handle and fixed with the shank for facilitating a user's hand to directly operate to rotate the shank.

1 Claim, 8 Drawing Sheets

SCREWDRIVER DEVICE

BACKGROUND OF THE INVENTION

1. Field of the Invention

The present invention relates to a screwdriver device, in particular to a multi-functional screwdriver device which achieves extraction or locking of a screw (nut) in a rapid, energy-saving and time-saving manner with stable application of force by the back-and-forth vacillating manipulation of the operating lever of the screwdriver device by hand 2. Description of the Related Art The present society is industrially and commercially flourishing and the use of hand tools is quite common in various professions, from mechanics, electronics, automobile repairs, plumbing and electrical works to DIY repair works in homes in general, none of which does not use such a tool as a screwdriver.

The screwdriver device according to the present invention is developed through actual operations and incessant improvements thereon.

SUMMARY OF THE INVENTION

An object of the present invention is to provide a screwdriver device characterized in that the pointed comers of a claw member move the gear by the back and forth vacillating movement of the operating lever, thereby rotating the screwdriver and achieving a rapid, energy-saving and time-saving function.

Another object of the present invention is to provide a screwdriver device characterized in that the two pointed corners of the claw member may be engaged with the toothed groove of the gear in the opposite direction for movement in the opposite direction, thereby achieving switching of the turning direction of the shank.

Still another object of the present invention is to provide a screwdriver device characterized by two-handed operation in that a user's hand may grip the movable handle on the shank and his other hand may manipulate the operating lever in a back-and-forth motion to facilitate stable application of force and increased efficiency.

Still a further object of the present invention is to provide a screwdriver device characterized by being single-handedly operable or usable in that the palm of a user half-grasp the handle and the operating lever and moving the same in a back-and-forth vacillating motion.

Still a further object of the present invention is to provide a screwdriver device characterized in that in use, a user's hand may directly operate to turn the shank.

Still a further object of the present invention is to provide a screwdriver device characterized in that the operating lever operates by the principle of lever so that the screwdriver device is more energy-saving and rapid in use.

Still a further object of the present invention is to provide a screwdriver device characterized by two-handed back-and-forth operation for continuous rotation of the screwdriver in use, and in which various drill bits, mill blades and tapping devices may be attached thereto.

Still a further object of the present invention is to provide a screwdriver device characterized in that the operating lever is positioned on a side of the shank for operation to facilitate its use in narrow spaces.

Accordingly, the present invention provides a screwdriver device comprising:

a handle;

a shank having a top end, a middle part, and lower part, the top end of the shank being movably mounted within the handle;

a gear provided at the middle part on said shank;

an operating lever extending from an upper plate and a lower plate formed therewith, and being operable in a back-and-forth vacillating motion to rotate said shank and achieve a rapid, energy-saving and time-saving function;

a claw member provided at a suitable position formed between said upper plate and said lower plate which are superposed, for switching the turning (rotating) direction of the screwdriver, said claw member having two pointed comers at the front end thereof which are switchable to the left or right to be respectively engaged into a groove of said gear and which, in use, move the screwdriver to rotation; and a rotary member provided at a suitable position on the handle and fixed with the screwdriver for facilitating a user's hand to directly operate to rotate the screwdriver.

BRIEF DESCRIPTION OF THE DRAWINGS

Other features and advantages of the present invention will become apparent in the following detailed description of a preferred embodiment with reference to the accompanying drawings, in which.

DETAILED DESCRIPTION OF THE PREFERRED EMBODIMENT

Figure 1:
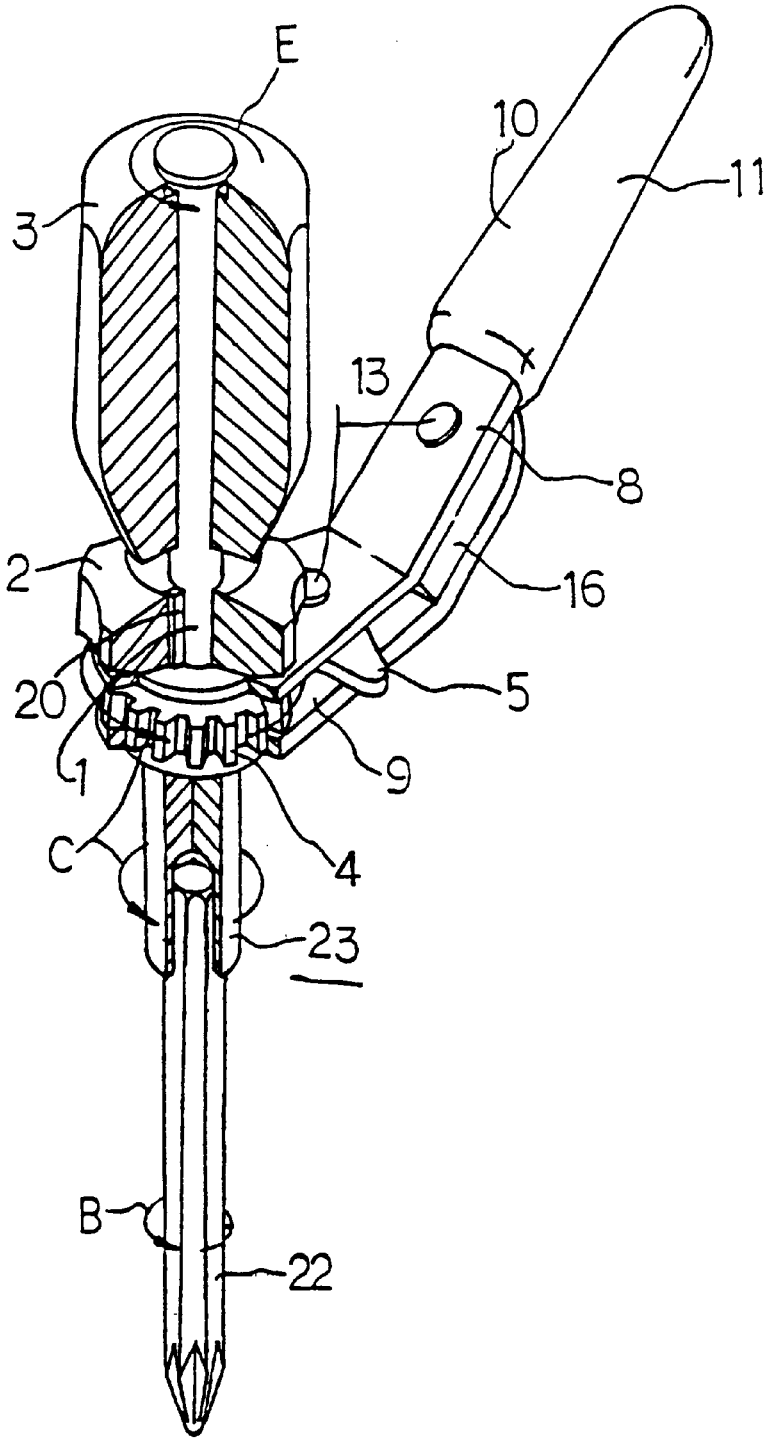
FIG. 1 is a sectional perspective view of the structure of an embodiment of the screwdriver device according to the present invention.

A preferred embodiment of the present invention will now be described with reference to the drawings. The screwdriver device according to the present invention, as shown in FIG. 1, comprises a shank 1 having one end embedded within a handle 3 and movable therein for rotation in the direction of the arrow E in use, and another end formed as a chuck sleeve 23 into which any of various types of tips 22 is sleeved; a rotary member 2 provided at a suitable position on the handle 3 and fixed thereon by a pin 20 provided on the shank 1, the rotary member 2 being directly rotatable in the direction of the arrow A to turn the shank 1 in the direction of the arrow E, C or B; a gear 4 provided at a suitable position below the rotary member 2 and fixed by the pin 20 of the shank 1; an operating lever 11 which extends to form an upper plate 8 and a lower plate 9 which are superposed to sandwich a space into which a claw member 5 is disposed at a suitable position thereof, the claw member 5 being switchable to the left or right and being fixed by a pin 13 passed therethrough.

Figure 2:
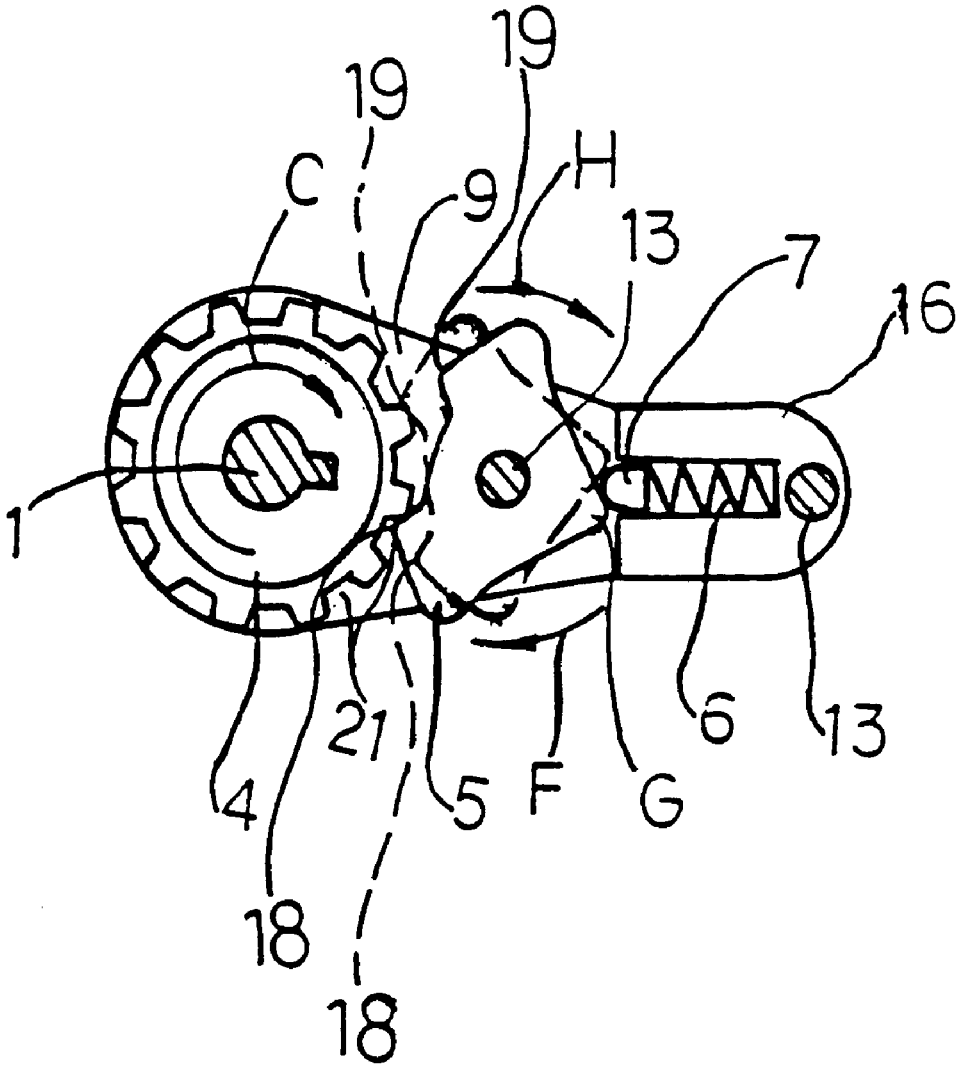
FIG. 2 is a plan view showing the structure of the claw member of the embodiment shown in FIG. 1.

With reference to FIG. 2, at a suitable distance behind the tail corner G of the claw member 5 is a bead 7 against which a spring 6 mounted in a spring seat 7 abuts, thus providing a stopping function when the two pointed corners 18 and 19 [of the claw member 5] are switched to the direction of the arrow F or H. When switched to the H direction, the pointed comer 18 is engaged into the groove 21 of the gear 4 and, by means of the operating lever 11, the pointed corner 18 is used to move and turn the gear 4 in the direction of the arrow C, and in turn drive the shank 1 to rotate in the direction of the arrow B or, E. In contrast, when switched to the F direction, the shank 1 is made to turn in the opposite direction.

Figure 3:
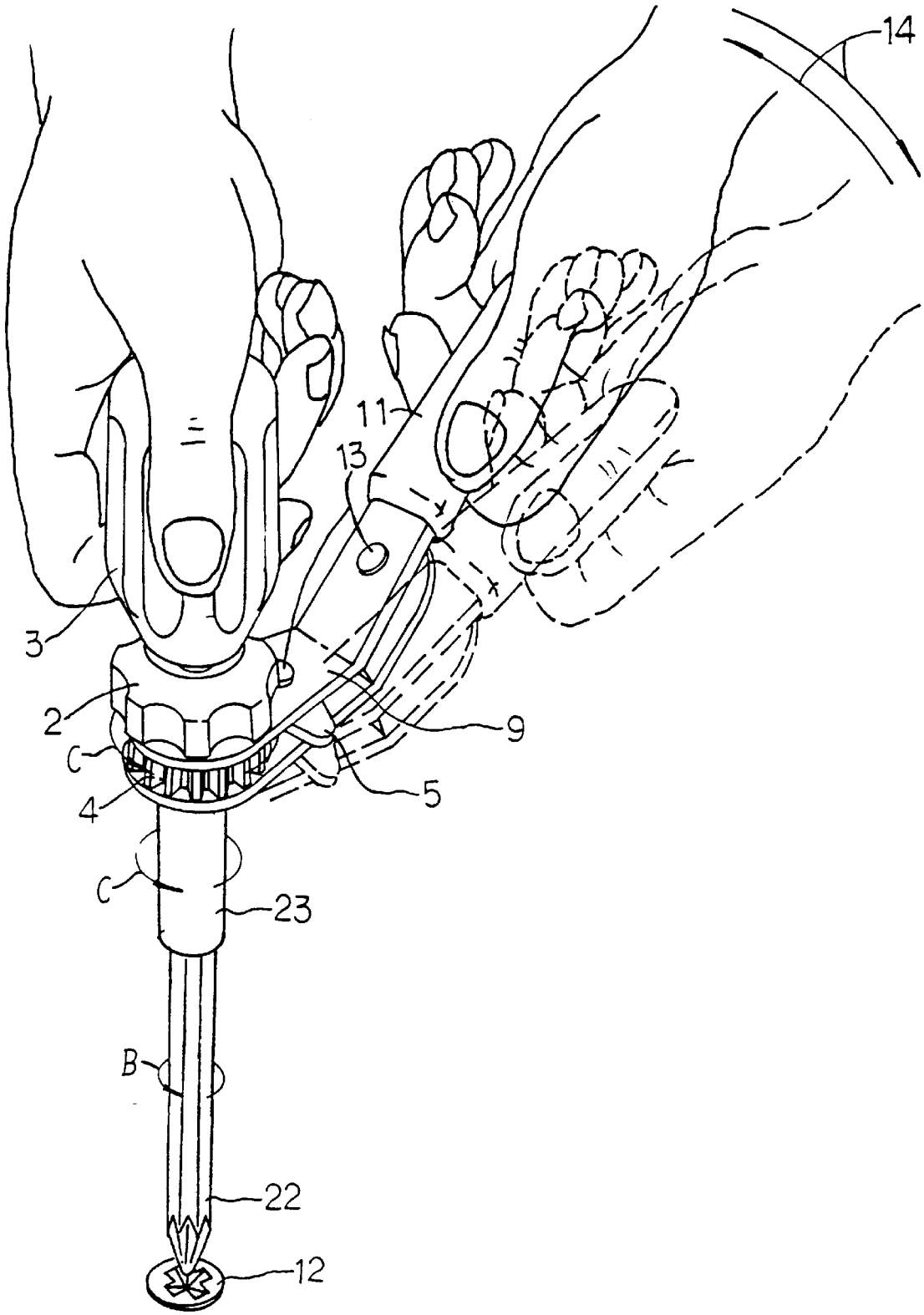
FIG. 3 is a perspective view showing the screwdriver device as used in a two-handed operation.

With reference to FIG. 3, the operation of the screwdriver device by a user using both hands will now be described. To remove or lock a screw, one hand of the user grips the handle 3 and the other hand grips the operating lever 11 and a back-and-forth vacillating force 14 is exerted thereon so that the claw member 5 moves the gear 4 to rotate in the direction of the arrow C, thereby achieving the function of a rapid, time-saving and energy-saving two-handed operation with stably applied force.

Figure 4:
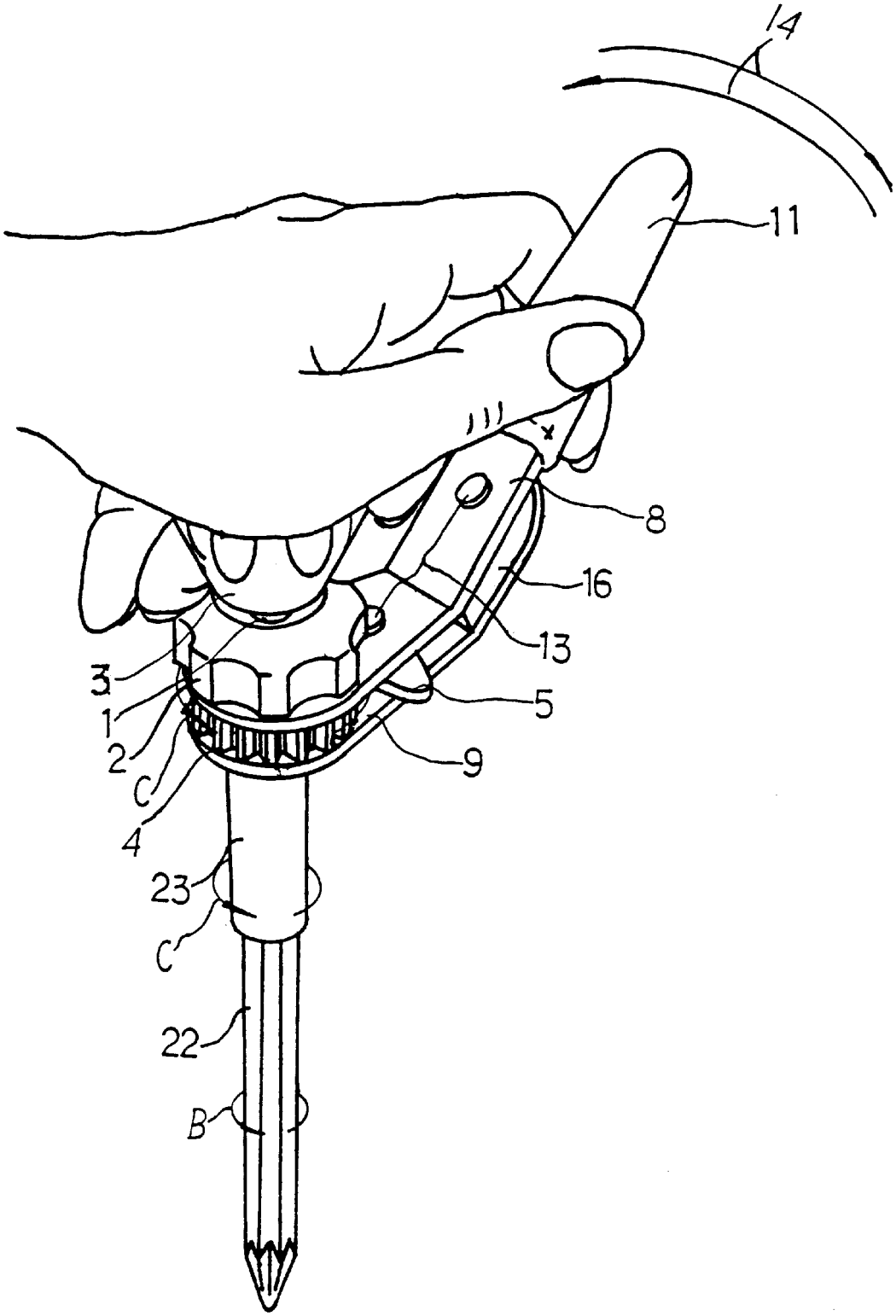
FIG. 4 is a perspective view showing the screwdriver device when used in a one-handed operation.

With reference to FIG. 4, the single-handed operation of the screwdriver device will now described. With his palm half-grasping both the handle 3 and the operating lever 11, the user exerts a back-and-forth vacillating force 14 on the operating lever 11 to achieve the function of a single-handed operation.

Figure 5:
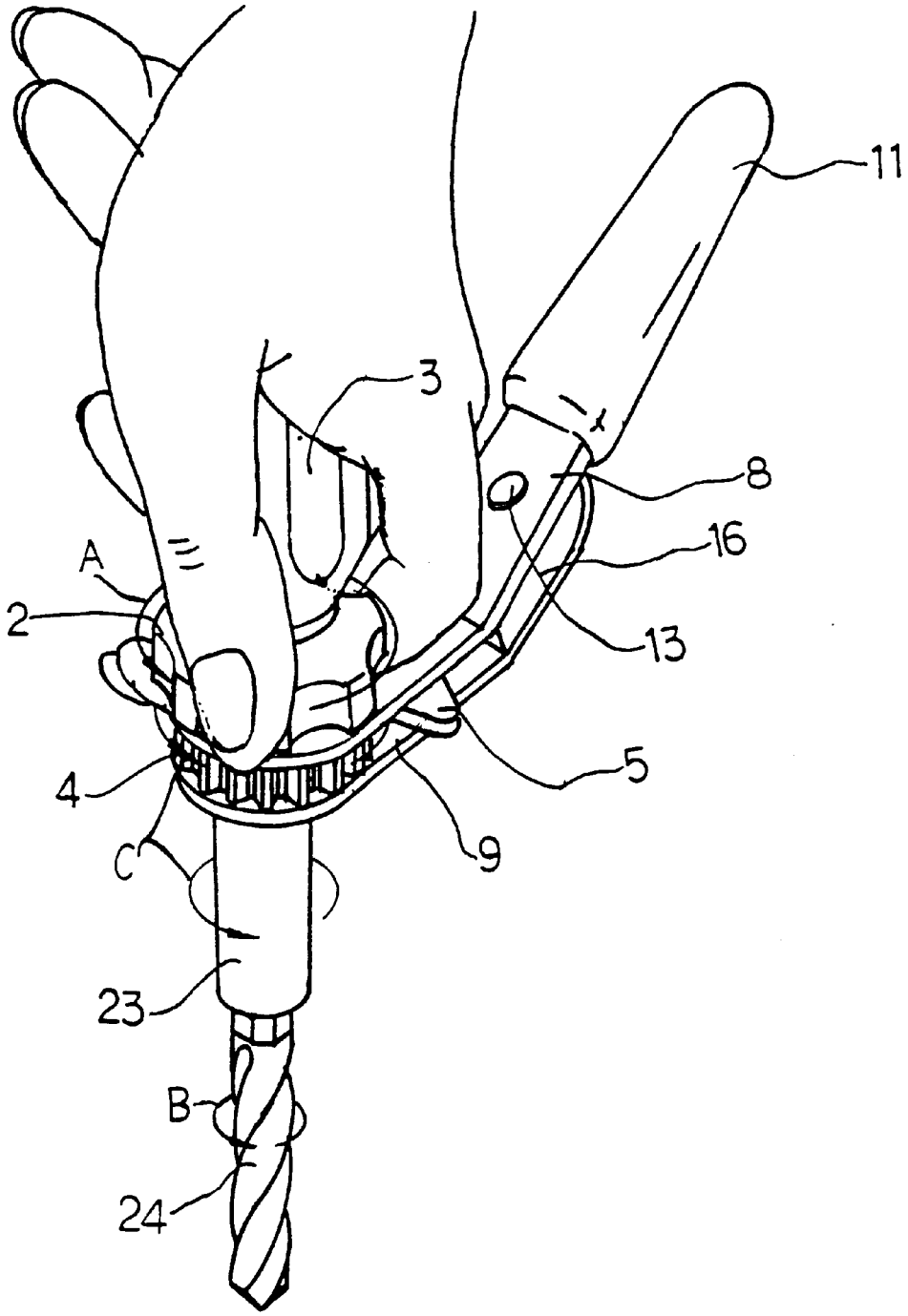
FIG. 5 is a perspective view of the screwdriver device showing the turning operation by hand of the rotary member of the screwdriver device and sleeving of a drill bit.

With reference to FIG. 5, the chuck sleeve 23 may be sleeved with various types of tips 22, or with drill bits 24. By continuously moving the shank 1 to rotate in the direction of the arrow B, the function of drilling a hole can be achieved. Manipulating the rotary member 2 by hand, turning it in the direction of the arrow A, will directly rotate the shank 1 in the direction of the arrow B, thereby achieving the function of operating a screwdriver.

Figure 6:
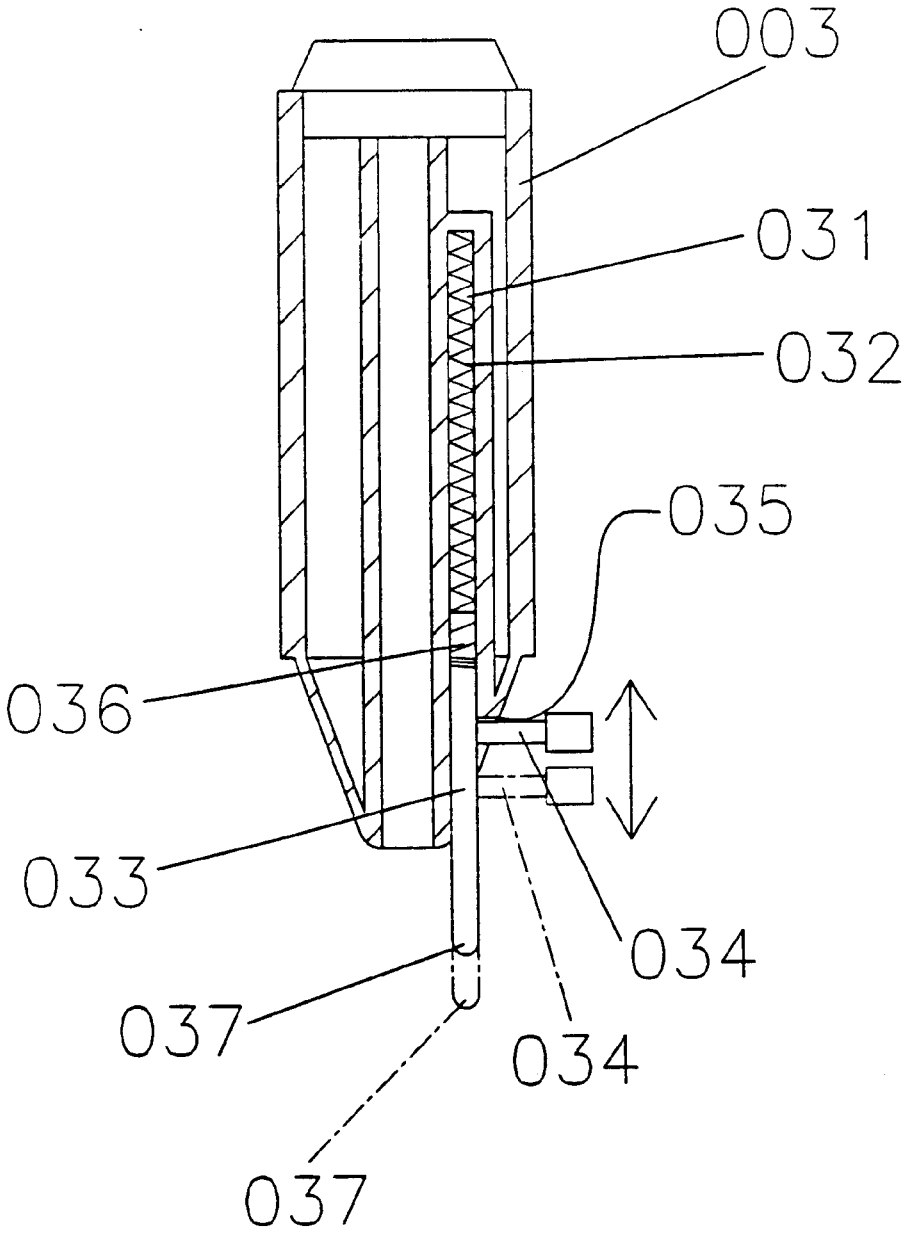
FIG. 6 is a sectional view of an alternative embodiment of the handle of the screwdriver device according to the present invention.

With reference to FIG. 6, an alternative embodiment of the present invention, directed to the handle of the screwdriver device, is shown. A longitudinal channel 31 may be provided on the handle 3 as necessary. Near the opening of the channel 31 is provided a positioning notch 35. A spring 32 may be disposed in the channel 31. An insertion rod 33 has a side on which a grip 34 is transversely mounted. The front end 36 of the rod 33 is positioned at the upper portion of the spring 32. The grip 34 is selectively engaged or released from the positioning notch 35. The inner surface of the gear 4 is provided with an insertion hole 41 (best shown in FIG. 7). The rear end 37 of the rod 33 is selectively inserted into the hole 41.

Figure 7:
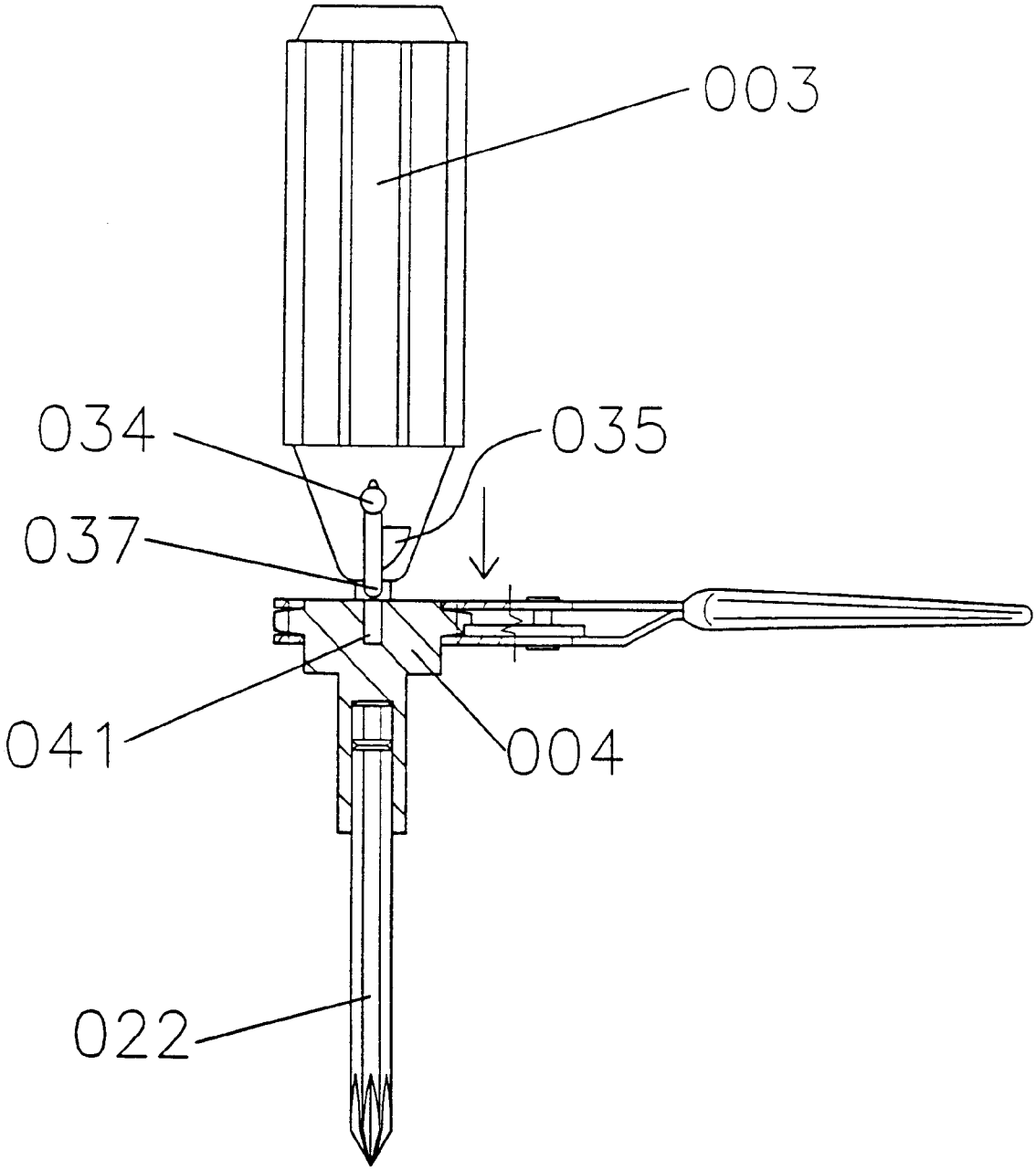
FIG. 7 is an operational view (A) showing the use of the handle depicted in FIG. 6 in conjunction with the gear.

Referring again to FIG. 6, the front end 36 is located at the upper end of the spring 32. The terminating end of the spring 32 is located at the bottom portion of the channel 31. When the insertion rod 33 is not in operation, as shown in FIG. 7, the grip 34 is not yet engaged into the positioning notch 35 and the front rod body 36 is not yet inserted into the hole 41. At this point, the gear 4 is not yet joined with the handle 3. However, due to the dead weight of the rod 33 itself, when the rear end 37 is aligned with the insertion hole 41, the rear end 37 will fall into the hole 41 and engage the grip 34 in the positioning notch 35, thereby effectively fixing the rod 33, so that the screwdriver device is used as a traditional screwdriver.

Figure 8:
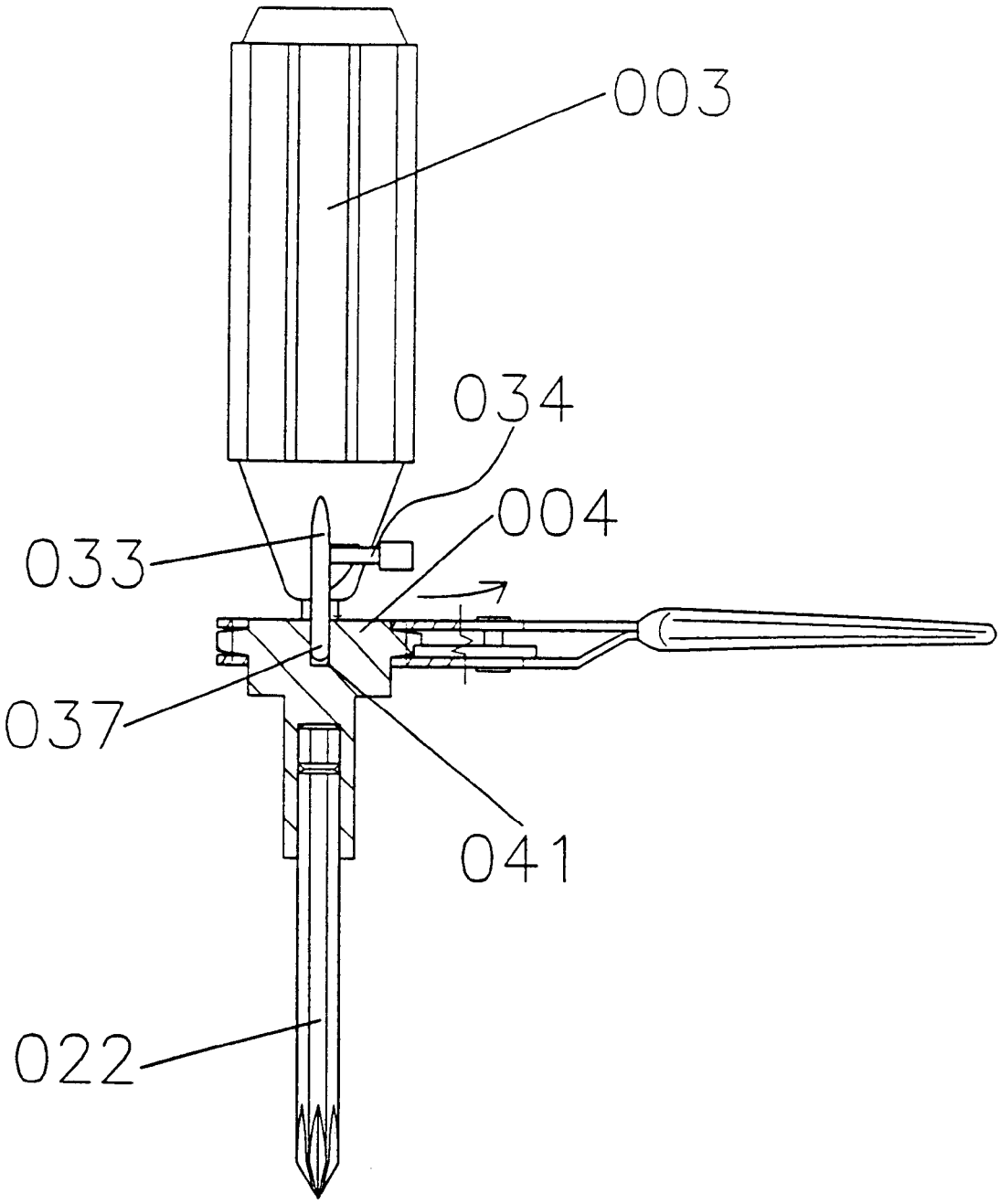
FIG. 8 is an operational view (B) showing the use of the handle depicted in FIG. 6 in conjunction with the gear.

As shown in FIG. 8, the handle 3 at this point, together with the gear 4 and the tip 22, are connected in series into one body, and in this way, the screwdriver device can be used as a traditional screwdriver. Rotating the handle 3 will synchronously rotate the tip 22. Evidently, the present invention can selectively use the application of force of a traditional screwdriver.

In view of the foregoing, the screwdriver device according to the present invention has the advantages of having multiple operational functions and being rapid, energy-saving, time-saving and providing stably applied force in use. In view of the practical effects assuredly possessed by the present invention, and since the present invention has not appeared in any prior printed publication, the present invention should fulfill the patent requirements.

It will be understood that the present invention may be embodied in other specific forms without departing from the spirit or central characteristics thereof. The present examples and embodiments, therefore, are to be considered in all respects as illustrative and not restrictive, and the present invention is not to be limited to the details given herein.

What is claimed is:

1. A screwdriver device comprising:

a handle having a longitudinal channel and a positioning notch wherein the positioning notch is adjacent to said longitudinal channel;

a spring having an upper portion and disposed in said longitudinal channel;

an insertion rod having a side on which a grip is transversely mounted, said insertion rod having a front end movably connected to the upper portion of said spring and being positioned in said longitudinal channel, and said grip being selectively engaged or released from said positioning notch;

a shank having a top end, a middle part, and lower part, the top end of the shank being rotatably mounted within the handle;

a gear provided at the middle part on said shank;

an operating lever extending from an upper plate and a lower plate formed therewith;

a claw member provided at a suitable position formed between said upper plate and said lower plate which are superposed, said claw member having two pointed corners at a front end thereof which are switchable to the left or right to be respectively engaged into a groove of said gear and which, in use, move the shank to rotation; and a rotary member provided at a suitable position on the handle and fixed with the shank for facilitating a user's hand to directly rotate the shank.

* * * * *